US006955841B2

(12) United States Patent
Weghuis et al.

(10) Patent No.: US 6,955,841 B2
(45) Date of Patent: Oct. 18, 2005

(54) ARTIFICIAL GRASS LAWN FOR SPORTS FIELDS

(75) Inventors: Marinus Hendrikus Olde Weghuis, Oldenzaal (NL); Geurt Bastiaan Slootweg, Enschede (NL)

(73) Assignee: Ten Cate Thiolon B.V., Nijverdal (NL)

( * ) Notice: Subject to any disclaimer, the term of this patent is extended or adjusted under 35 U.S.C. 154(b) by 0 days.

(21) Appl. No.: 10/297,609

(22) PCT Filed: Jun. 14, 2001

(86) PCT No.: PCT/NL01/00448

§ 371 (c)(1),
(2), (4) Date: Apr. 22, 2003

(87) PCT Pub. No.: WO01/96664

PCT Pub. Date: Dec. 20, 2001

(65) Prior Publication Data

US 2003/0157275 A1 Aug. 21, 2003

(51) Int. Cl.[7] ..... B32B 7/00; B32B 3/00; A41G 1/00

(52) U.S. Cl. ..... 428/17; 428/15; 428/85; 428/87; 428/92

(58) Field of Search ..... 428/15, 17, 85, 428/87, 92

(56) References Cited

U.S. PATENT DOCUMENTS

| | | | | |
|---|---|---|---|---|
| 3,940,522 A | | 2/1976 | Wessells | 428/17 |
| 5,601,886 A | * | 2/1997 | Ishikawa et al. | 428/17 |

FOREIGN PATENT DOCUMENTS

| | | | | |
|---|---|---|---|---|
| EP | 0678622 A1 | | 10/1995 | |
| WO | WO93/09293 | | 5/1993 | |
| WO | WO 200148322 A1 | * | 7/2001 | A41G/1/00 |

OTHER PUBLICATIONS

Partial machine translation of WO 93/09293.*

* cited by examiner

*Primary Examiner*—Stephen Stein
(74) *Attorney, Agent, or Firm*—Jacobson Holman PLLC

(57) ABSTRACT

The invention relates to an artificial grass lawn suitable for sports fields, which artificial grass lawn consists of a base layer, on which first artificial grass fibres are disposed. In accordance with the invention, the artificial grass lawn is characterized in that said base layer comprises a material having damping properties, which is present thereon and/or therein. Thus the properties of a natural grass field are approximated very closely, and also the style of play on the sports field is positively affected. Furthermore, the artificial grass field thus obtained is substantially free of maintenance and of injury.

18 Claims, 3 Drawing Sheets

ARTIFICIAL GRASS LAWN FOR SPORTS FIELDS

Figure 1A:
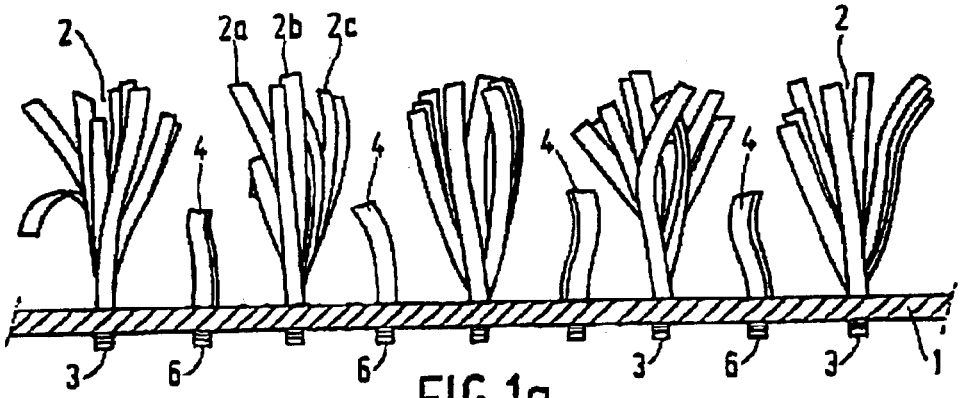

This is a nationalization of PCT/NL01/00448 filed. Jun. 14, 2001 and published in English.

The invention relates to an artificial grass lawn suitable for sports fields, which artificial grass lawn consists of a base layer, on which first artificial grass fibres are disposed.

Many sports, such as field hockey, tennis, American football and so forth, are played on artificial grass fields these days, which sports fields comprise artificial grass lawns as referred to in the introduction. Although sports people sustain fewer injuries due to falling, making slidings, etc. on natural grass fields, due to the soft surface thereof, such sports fields are hard worn, in particular by the aforesaid sports, owing to the intensive use that is made thereof and the changing influence of the weather conditions.

Artificial grass fields, on the other hand, require less maintenance and can be used much more intensively than natural grass fields. On artificial grass fields, however, the risk of sustaining injuries is considerably greater, due to the higher frictional resistance between the players' skin and the artificial grass fibres.

This latter drawback is overcome in large part these days by filling the spaces between the artificial grass fibres with a granular material, such as grains of sand or of a synthetic material. The presence of said grains between the fibres not only provides a softer, damping surface, which thus reduces the risk of injury, but in addition, it leads to an improved style of play.

The filling of the spaces between the fibres of an artificial grass lawn has a number of drawbacks. Not only is the construction of such an artificial grass field more labour-intensive, but in addition, an artificial grass field filled with a granular material requires maintenance after its construction. The originally uniform distribution of the damping material is disrupted by the weather influences or by the intensive use that is made of the field. In the latter case, areas are formed in the artificial grass field where hardly any filling material remains, in particular areas which are played on very intensively, for example the goal area, which has an adverse effect on the play itself, but which also causes the risk of injury to increase. In a sand-filled artificial grass field, frequent refilling with sand is necessary, therefore.

The object of the invention is to provide an artificial grass field which is substantially free of maintenance and which does not exhibit the aforesaid drawbacks. In accordance with the invention, the artificial grass lawn is characterized in that said base layer comprises a material having damping properties, which is present thereon and/or therein. The drawbacks of filling the spaces between the artificial fibres with damping material are thus completely overcome, so that an artificial grass field obtained in this manner is substantially free of maintenance. Moreover, the damping material can be worked into the artificial grass lawn during the manufacturing process already, so that the artificial grass field can be constructed in one operation. This leads to a considerable saving of labour.

Furthermore, such an artificial grass lawn is much more capable of absorbing the energy and the shocks to which the fibres are exposed by the players and the attributes they use, such as balls.

In order to provide an artificial grass field which exhibits strongly improved playing characteristics, the material may also have moisture-absorbing properties.

According to one embodiment of the invention, the material consists of further synthetic fibres which are worked into the base layer. The length of said further artificial grass fibres is preferably smaller than that of the first artificial grass fibres, said length being 10%–50% of the length of said first artificial grass fibres, for example. In another embodiment, said further fibres consist of one or more bundles of monofilaments or of twisted fibres.

During the manufacturing process, said further fibres can be worked into the base layer simultaneously with said first artificial grass fibres, for example by means of a weaving, knitting or tufting technique.

An artificial grass lawn having optimum damping properties is obtained if said fibres are of spiral or helical shape.

An artificial grass lawn which also has moisture-regulating properties, so that this lawn comes nearest to natural lawn, and which furthermore has a positive effect on the style of play, is according to the invention characterized in that said further synthetic fibres are hollow.

Such synthetic fibres may furthermore have damping properties, in that they are configured as bellows.

In another embodiment, the artificial grass lawn is according to the invention characterized in that the material is fixed to the base layer around said first artificial grass fibres. A considerable simplification of the manufacturing process can be obtained in that the material is fixed to the base layer by means of said artificial grass fibres. Said material may be a mat, which may be integral with the base layer in another embodiment of the invention.

Furthermore, the base layer of the artificial grass lawn may have a closed or an open structure. In the latter embodiment, the artificial grass lawn is very suitable for use in a hybrid grass field, or combination grass field, wherein the open structure allows the passage of water and roots of seeded natural grass.

The damping material is preferably made from a type of material different from that of the actual artificial grass fibres, for example rubber. This material not only has good damping properties, but its resilience comes nearest to that of natural soil, furthermore it has a positive influence on the style of play and it is a player-friendly material as far as injuries are concerned.

Alternatively, the damping material may be made from a synthetic foam product, optionally an open synthetic foam product. In this latter embodiment, the damping material is capable of absorbing moisture, so that the field will exhibit strongly improved playing characteristics. In addition, the risk of injury is further reduced in this manner.

The invention will now be explained in more detail with reference to a drawing, which successively shows in:

FIGS. 1*a*–1*h* various embodiments of an artificial grass lawn according to the invention.

For the sake of clarity, parts corresponding to each other are indicated by the same numerals in FIGS. 1*a*–1*h*. The artificial grass lawn according to the invention is built up of a base layer 1, on which artificial grass fibres 2 are present. Fibres 2 are fixed in base layer 1 at 3, for example by means of a weaving, knitting or tufting technique. Usually, artificial grass fibres 2 comprise several fibres 2*a*, 2*b*, 2*c*, etc., so as to come as near to the structure of natural grass as possible. By filling the spaces between said artificial grass fibres 2 with a granular material, such as grains of sand or of a synthetic material, the standard artificial grass lawn will have a softer, damping surface, whilst in addition the field will exhibit much improved playing characteristics.

As already noted above, there are still a number of drawbacks attached to filling the spaces between the fibres of artificial grass fields, one of the major drawbacks being the fact that the originally uniform distribution of the filling material is disrupted.

This aspect is fully overcome in that, in accordance with the invention, said base layer 3 comprises a material having damping properties, which is present thereon and/or therein. In FIG. 1*a*, said damping material is in the form of further artificial grass fibres 4, which have been worked into base layer 1, near places 6, in an analogous manner by weaving, knitting or tufting. Artificial grass fibres 4, whose length is preferably smaller than that of the actual artificial grass fibres 2, are made from a type of material different from that of fibres 2, in particular said further artificial grass fibres 4 are made of rubber. This type of material provides the desired damping properties, so that an artificial grass lawn having a soft subbase.

As a result of the damping properties of the artificial grass lawn according to the invention, shocks resulting from the more intensive and usually varying (both as regards energy and as regards direction) loads exerted thereon by the players and the attributes they use can be absorbed much more effectively and be transmitted to base layer 3 (and to the subbase on which said base layer 3 is disposed). Not only are the actual artificial grass fibres 2 loaded much less in this way, as a result of which their life is extended, but in addition the way of playing on a natural lawn is approximated as closely as possible whilst preventing injuries.

Figure 1B:
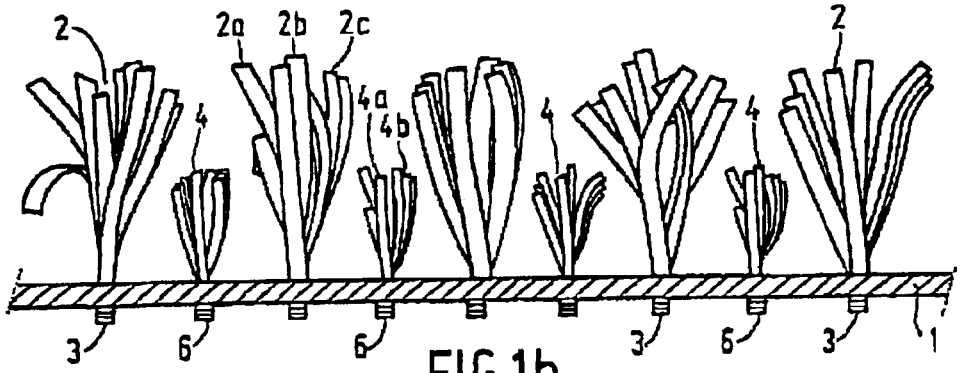

In FIG. 1*a*, the damping artificial grass fibres 4 are monofilaments, but they may also comprise a bundle 4 consisting of several filaments 4*a*, 4*b*, etc., as is shown in FIG. 1*b*.

Optionally, said further artificial grass fibres may comprise twisted synthetic yarns.

Figure 1C:
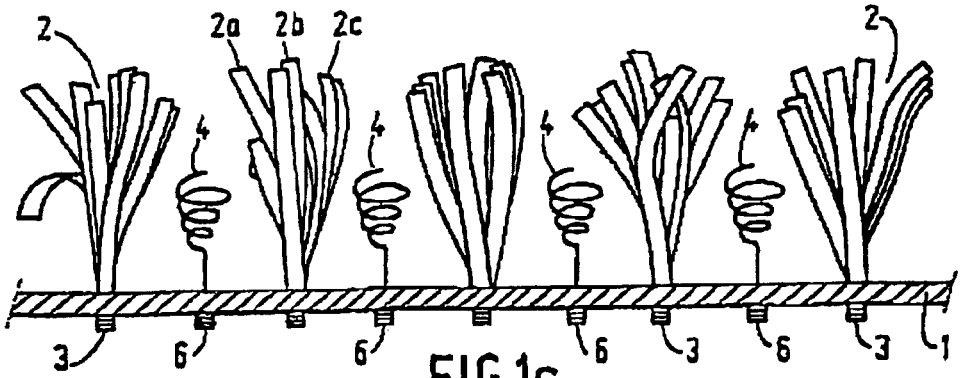

FIG. 1*c* shows another construction of the artificial grass lawn, which, according to the invention, comprises a material having damping properties, which has been placed onto or worked into base layer 1. Said further artificial grass fibres 4 are spiral-shaped in this embodiment. Said spiral shape functions as a spring, so that a damping sensation is created when setting foot on and playing on the artificial grass lawn.

Figure 1D:
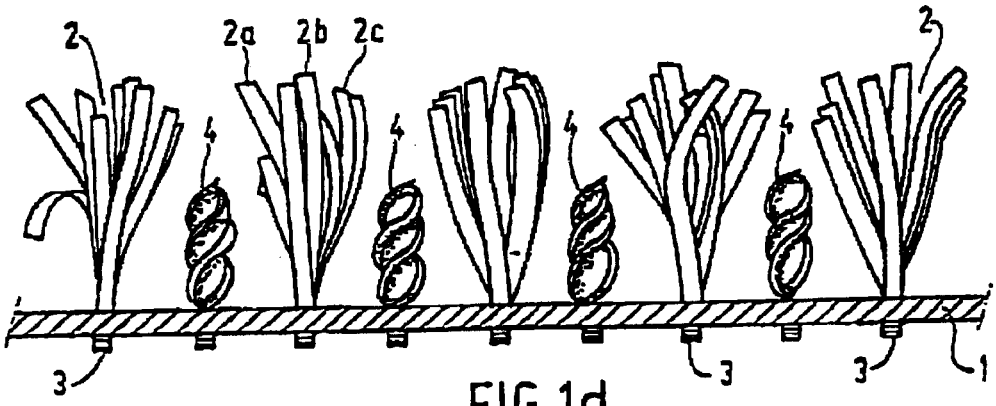

In another embodiment, which is shown in FIG. 1*d*, said further artificial grass fibres 4 have a helical structure. Also this helical shape provides a damping or resilient surface, as a result of which the risk of injury upon playing on this lawn is significantly reduced.

Figure 1E:
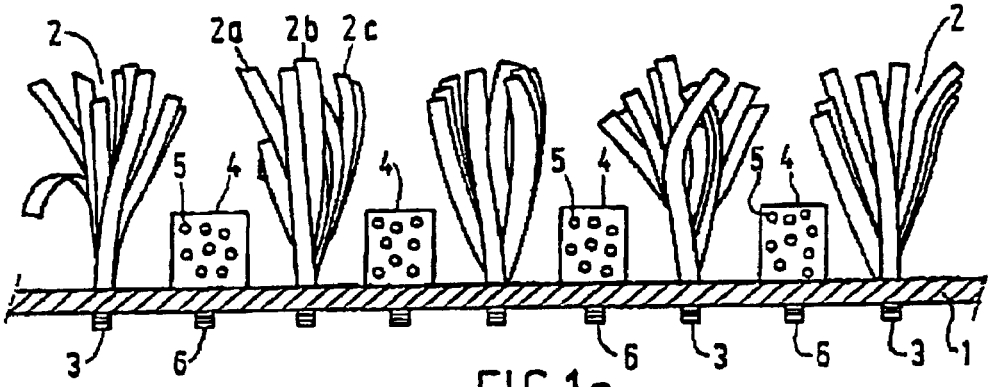
Figure 1F:
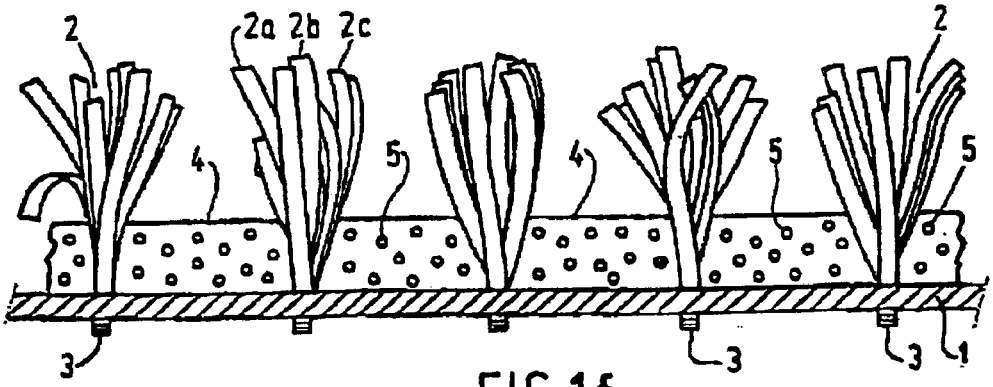

In FIGS. 1*e* and 1*f*, the damping material 4 is not in the form of an artificial grass fibre, but it has a spatial structure in the form of blocks or strips 4 (FIG. 1*e*), or a damping mat 4 as shown in FIG. 1*f*. As is shown in FIG. 1*e*, said blocks of damping material 4 can be fixed to the base layer in regularly spaced-apart relationship between artificial grass fibres 2. In one possible embodiment, the damping material 4, which is in the form of strips, can be placed between the artificial grass fibres 2 in elongated, parallel rows.

In another embodiment, the damping material 4 may have a grid-like structure, wherein the artificial grass fibres 2 are each fixed to base layer 1 in a mesh of said grid.

In FIG. 1*f*, said damping material 4, is fixed to base layer 1 in the form of a mat by means of artificial grass fibres 2. Such a construction is very easy to manufacture in one manufacturing step.

Figure 1G:
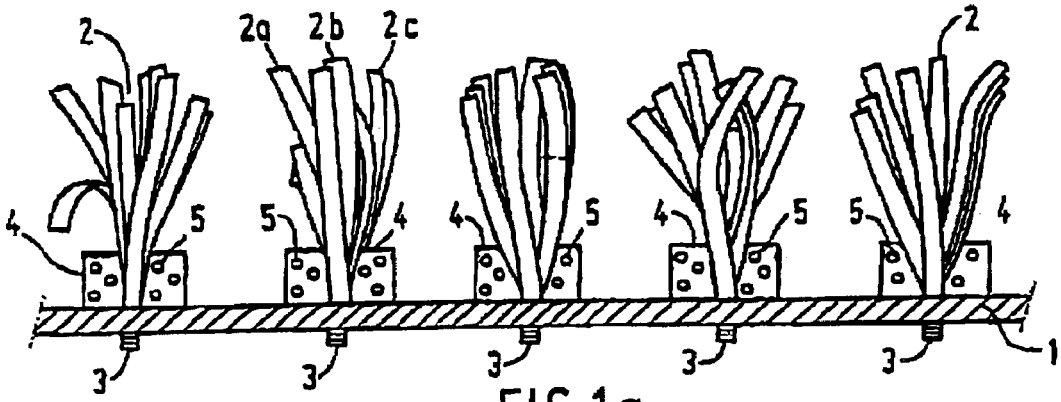

In FIG. 1*g*, the material 4 surrounds the artificial grass fibres 2, wherein fibres 2 also fix the material 2 to the base layer 1. Thus the material 4 not only protects the fixation of the fibres 2 to base layer 1, in a similar manner as in FIG. 1*f*, but said material 4 also gives the artificial grass lawn its specific damping and resilient properties around the "roots" of fibres 2.

Optionally, the damping material 4 may be made of rubber, as used in FIGS. 1*e*, 1*f* and 1*g*, or a synthetic foam product may be used. If a synthetic foam product is used, the artificial grass lawn will have specific damping and resilient properties, which not only reduce the risk of injury to a significant degree, but which also lead to a more agreeable style of play. This effect is achieved in that the synthetic foam product 4 has a cellular structure or a pore structure.

The use of an open synthetic foam product for damping material 4, not only provides the artificial grass lawn with damping properties but also with moisture-regulating properties. The fact is that the open foam product is capable of absorbing moisture, for example from rainfall, and to retain said moisture in said cellular structure or pore structure for a prolonged period of time. The water balance thus created comes nearest to that of a natural grass field. Furthermore it has become apparent that a moist artificial grass lawn reduces the risk of injury to a significant degree and that it has a positive effect on the speed of play on the artificial grass lawn.

Figure 1H:
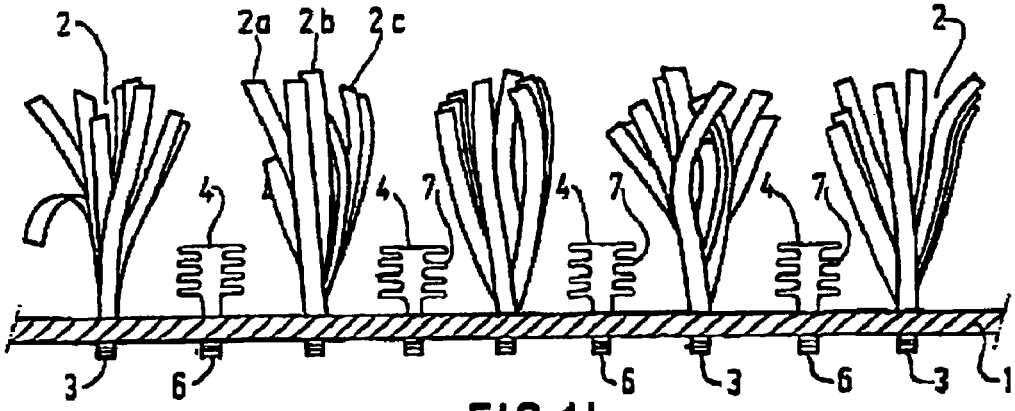

In another embodiment, which is shown in FIG. 1*h*, wherein an artificial grass lawn according to the invention not only has additional damping properties but also moisture-regulating properties, hollow fibres 4 are disposed between artificial grass fibres 2. Due to said hollow shape, the fibres 4 not only have absorbing, and thus damping or resilient properties, but in addition it enables to fibre 4 to collect and retain moisture. A very specific hollow fibre having very typical damping properties is shown in FIG. 1*h*. The fibre that is shown therein is configured as bellows comprising several pleats 7, which are resiliently disposed with respect to each other.

It will be understood that the invention is not limited to the illustrated embodiments, but that other alternatives are conceivable, which are considered to fall within the scope of the invention. The base layer may have a closed structure or an open structure thereby.

Furthermore it is possible to use all kinds of combinations of the illustrated embodiments in order to obtain a artificial grass field which has the optimum and desired properties as regards damping, resilience and moisture regulation, possibly in specific areas, for example the goal area.

What is claimed is:

1. Artificial grass lawn suitable for sports fields, said artificial grass lawn comprising a base layer, on which first artificial grass fibres are disposed, and further artificial grass fibres that are worked into said base layer, wherein said further artificial grass fibres exhibit damping properties and have a helical shape.

2. Artificial grass lawn according to claim 1, characterized in that said further artificial grass fibres have moisture-regulating properties.

3. Artificial grass lawn according to claim 1, characterized in that said further artificial grass fibres are smaller in length than said first artificial grass fibres.

4. Artificial grass lawn according to claim 3, characterized in that the length of said further artificial grass fibres is approximately 10%–50% of the length of said first artificial grass fibres.

5. Artificial grass lawn according to claim 1, characterized in that said further artificial grass fibres are monofilaments.

6. Artificial grass lawn according to claim 1, characterized in that said further artificial grass fibres are composed of twisted fibres.

7. Artificial grass lawn according to claim 1, characterized in that said further artificial grass fibres are hollow.

8. Artificial grass lawn according to claim 1, characterized in that said base layer has a closed structure.

9. Artificial grass lawn according to claim 1, characterized in that said base layer has an open structure.

10. Artificial grass lawn according to claim 1, characterized in that said further artificial grass fibres are made of rubber.

11. Artificial grass lawn suitable for sports fields, said artificial grass lawn comprising a base layer, on which first artificial grass fibres are disposed, and further artificial grass fibres that are worked into said base layer, wherein said further artificial grass fibres exhibit damping properties, and wherein said further artificial grass fibres are hollow and configured as bellows.

12. Artificial grass lawn according to claim 11, characterized in that said further artificial grass fibres have moisture-cregulating properties.

13. Artificial grass lawn according to claim 11, characterized in that said further artificial grass fibres are smaller in length than said first artificial grass fibres.

14. Artificial grass lawn according to claim 11, characterized in that the length of said further artificial grass fibres is approximately 10%–50% of the length of said first artificial grass fibres.

15. Artificial grass lawn according to claim 11, characterized in that said further artificial grass fibres are composed of twisted fibres.

16. Artificial grass lawn according to claim 11, characterized in that said base layer has a closed structure.

17. Artificial grass lawn according to claim 11, characterized in that said base layer has an open structure.

18. Artificial grass lawn according to claim 11, characterized in that said further artificial grass fibres are made of rubber.

* * * * *